United States Patent [19]

D'Antonio

[11] 4,309,760

[45] Jan. 5, 1982

[54] ELECTRONIC INTEGRATING SYSTEM

[76] Inventor: Nicholas F. D'Antonio, 7695 Admiral Dr., Liverpool, N.Y. 13088

[21] Appl. No.: 56,096

[22] Filed: Jul. 9, 1979

[51] Int. Cl.[3] ..... G06G 7/18; A63C 9/08

[52] U.S. Cl. ..... 364/835; 280/612; 364/829

[58] Field of Search ..... 280/612, 630, 735; 328/127; 364/819, 835, 829

[56] References Cited

U.S. PATENT DOCUMENTS

| | | | |
|---|---|---|---|
| 3,470,367 | 9/1969 | Frisby et al. | 364/835 X |
| 3,541,318 | 11/1970 | Miller | 364/831 |
| 3,566,088 | 2/1971 | Crook | 364/819 |
| 3,598,981 | 8/1971 | Conger et al. | 364/831 |
| 3,763,361 | 10/1973 | Smart | 328/127 |
| 3,800,203 | 3/1974 | Pedersen et al. | 328/127 |
| 3,820,109 | 6/1974 | Konrad et al. | 364/835 |
| 4,001,698 | 1/1977 | Allred | 328/127 |
| 4,059,751 | 11/1977 | Eriksson | 364/829 |
| 4,160,555 | 7/1979 | Salomon | 280/612 |

*Primary Examiner*—Felix D. Gruber

*Attorney, Agent, or Firm*—Squire, Sanders & Dempsey

[57] ABSTRACT

A system for integrating signals at a rate according to the characteristics of the signals. These characteristics include the direction of change of the signals and their magnitude. A ski binding release system incorporating a force responsive integration circuit having a variable integration rate is also disclosed.

15 Claims, 11 Drawing Figures

BLOCK DIAGRAM FOR TRACKING THRESHOLD INTEGRATOR

FIG. 3 BLOCK DIAGRAM FOR TRACKING THRESHOLD INTEGRATOR

FIG. 4 TIMING DIAGRAM FOR TRACKING THRESHOLD INTEGRATOR

FIG. 5 GRAPHICAL REPRESENTATION OF TYPICAL SITUATION USING TRACKING THRESHOLD

FIG. 6 DETAILED SCHEMATIC OF TRACKING THRESHOLD INTEGRATOR

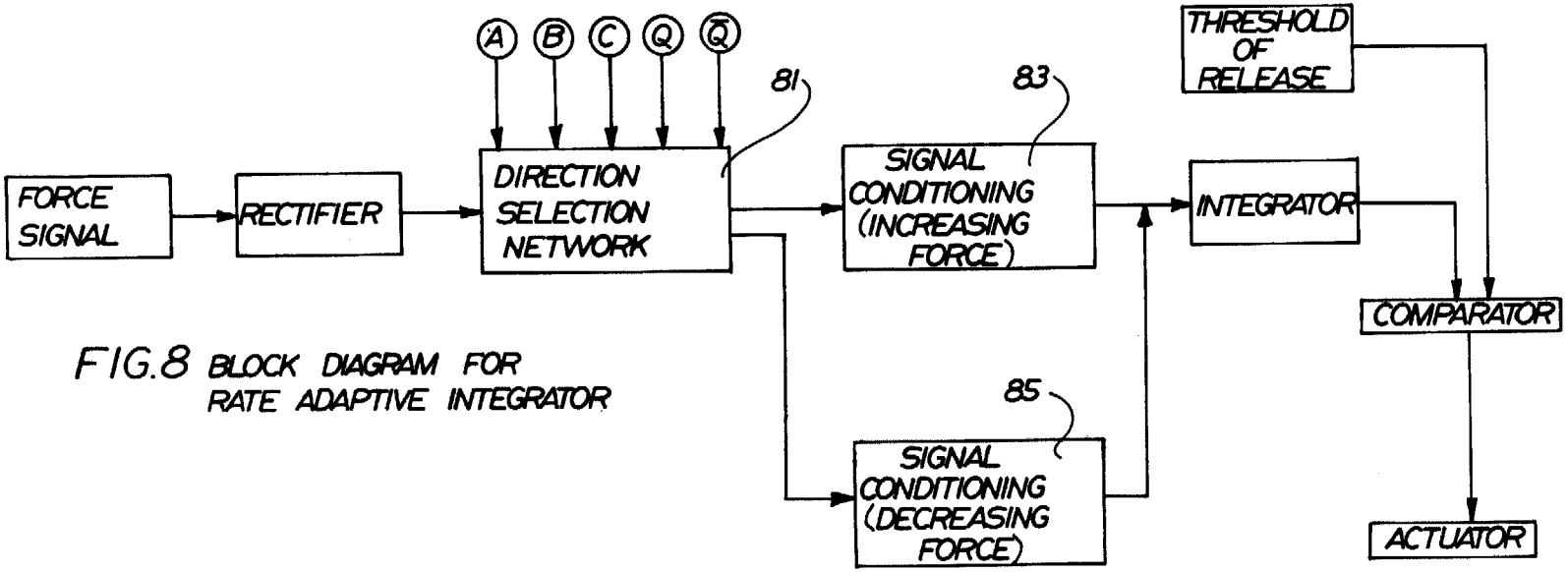
FIG. 8 BLOCK DIAGRAM FOR RATE ADAPTIVE INTEGRATOR
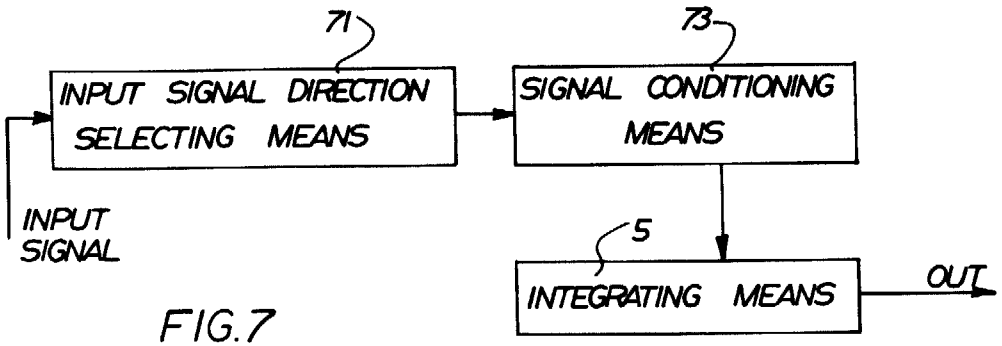
FIG. 7

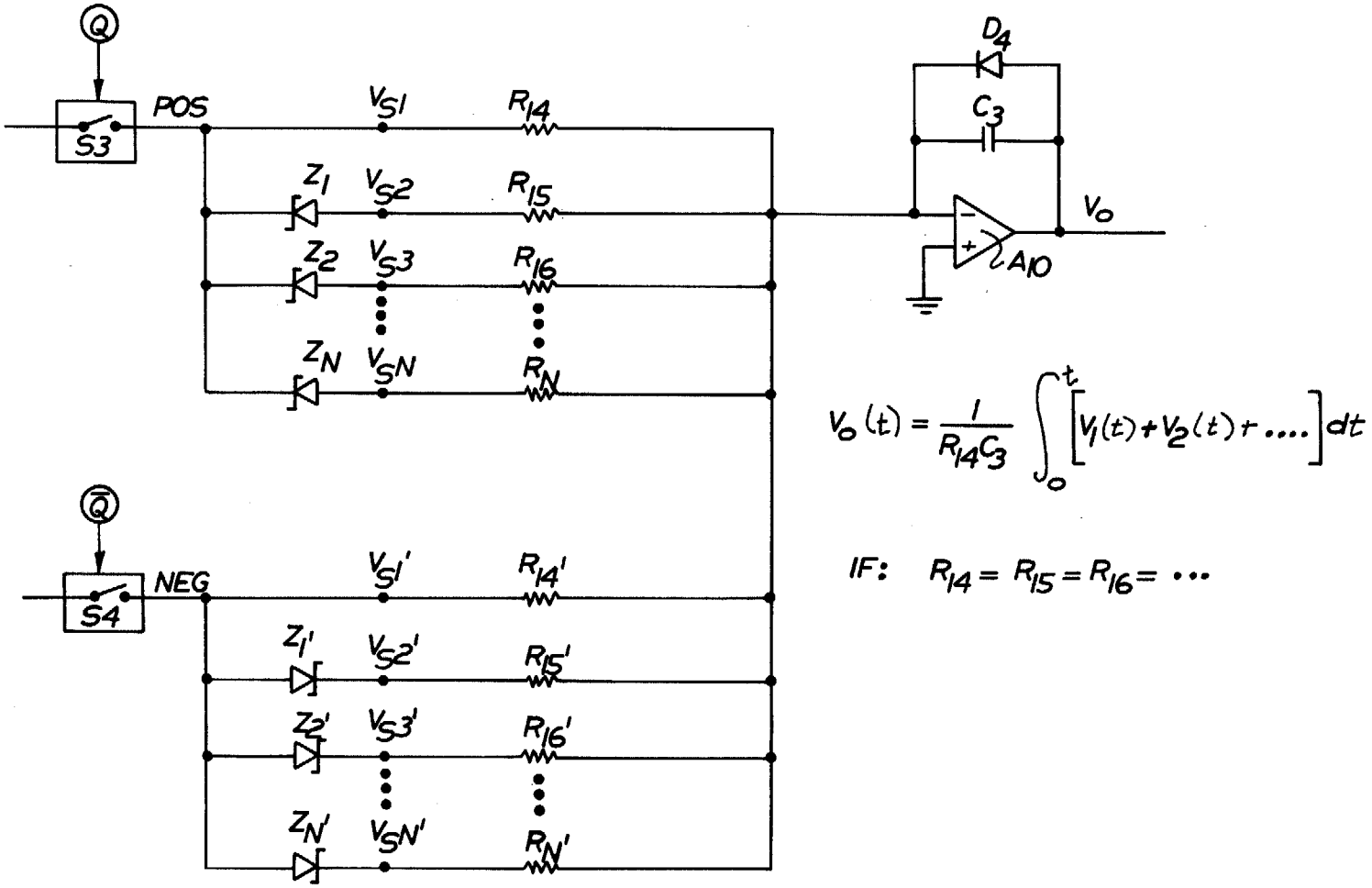
FIG.9 SIGNAL CONDITIONING NETWORK FOR ADAPTIVE INTEGRATOR

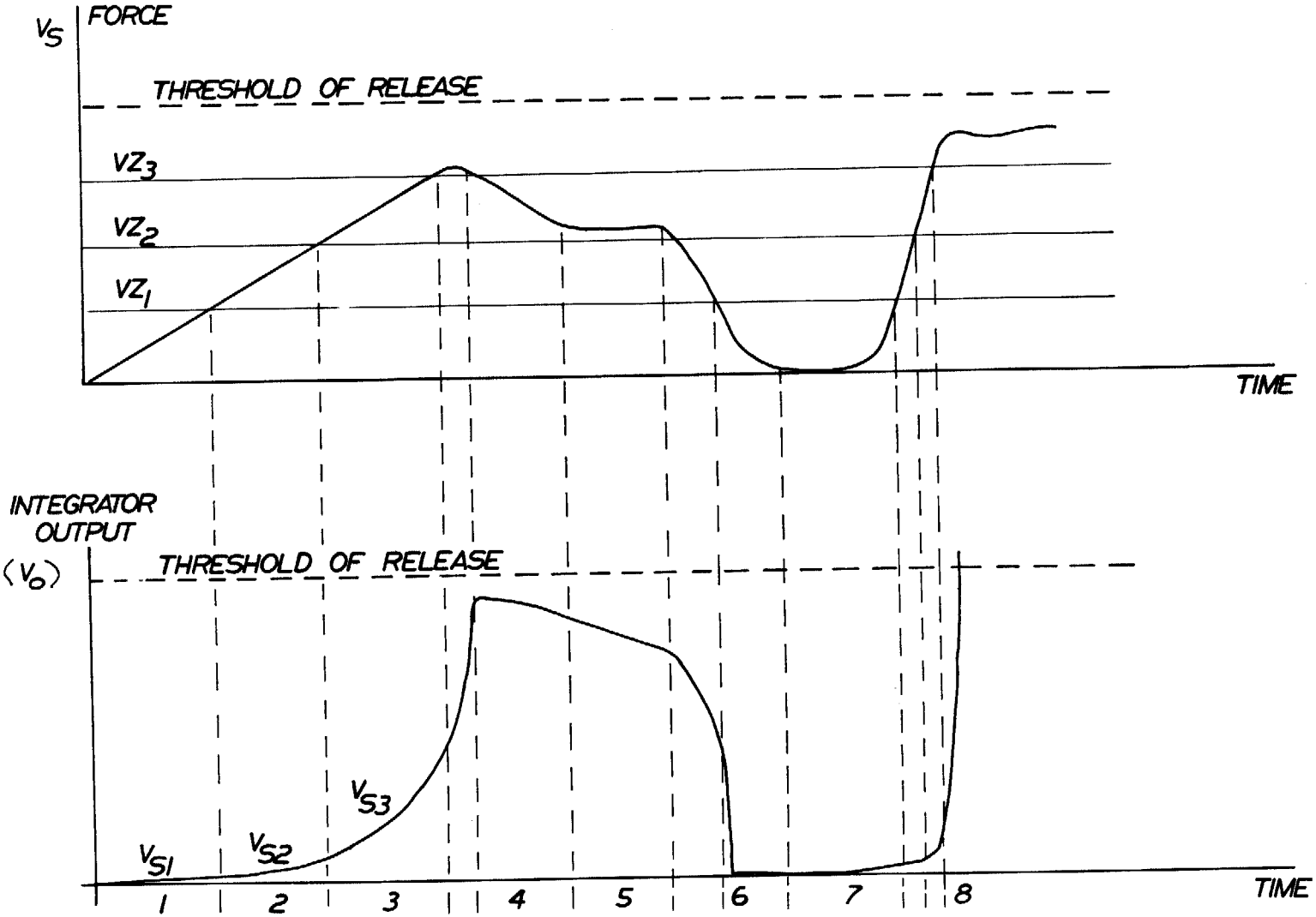
FIG. 10 FORCE-TIME GRAPH OF "RATE ADAPTIVE" INTEGRATION WITH "TRACKING THRESHOLD"

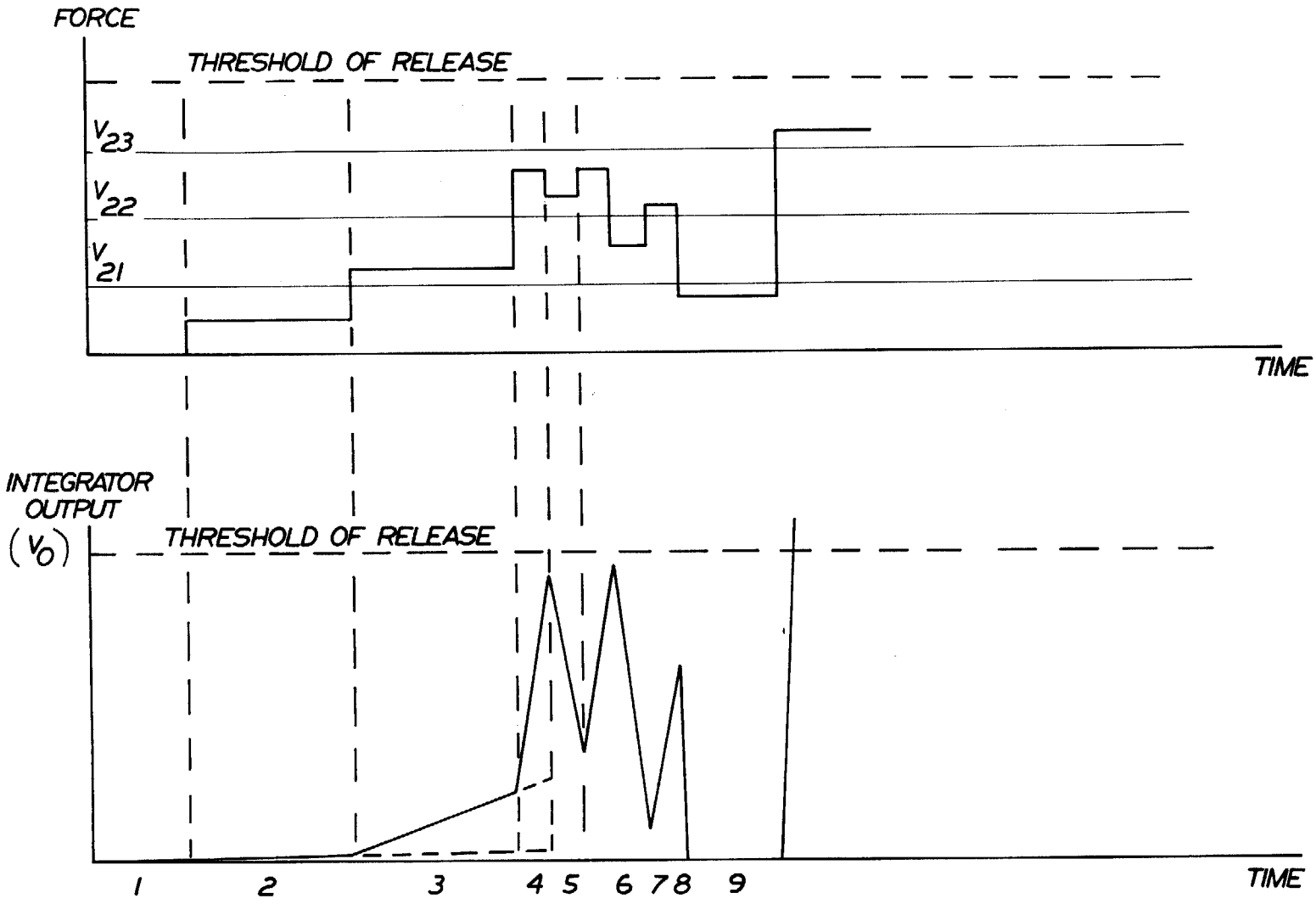
FIG. 11 FORCE TIME-GRAPH OF "RATE ADAPTIVE" INTEGRATOR WITH "STEP" INPUTS

ELECTRONIC INTEGRATING SYSTEM

BACKGROUND OF THE INVENTION

This invention relates to electronic integration systems which generate output signals corresponding to the integral of input signals over a period of time. The invention further relates to the measurement forces as a function of time, and to the generation of electrical signals according to the value of measured forces. The invention relates further to electronic ski binding systems, wherein a safety binding may be placed in a released condition upon the generation of electrical signals reflective of the occurrence of forces which could cause injury or damage.

Electronic integrating circuits are well known wherein an output signal is generated corresponding to the integral of an input signal over a predetermined period of time. For example, a basic electronic integrating circuit may include an operational amplifier having a resistance load at an input port, a capacitive load connected across the amplifier, and an output port. A reset switch is ordinarily provided for discharging the capacitor to enable repetitive integrations from a preselected reference. The parameters of these known integrators may be expressed mathematically as follows:

$$V_o = \frac{1}{RC} \int_o^t V_{in}(t)dt$$

where $V_o$=output voltage $V_{in}$=input voltage as a function of time

R=resistance

C=capacitance t=time

Such integrating circuits are discussed in the following publications: "Analog Computer Techniques" by Clarence Johnson; published in 1956 by McGraw-Hill Book Company, Inc.—pages 3, 37, 59, 60, 61, 85, 89, 196; "Handbook of Operational Amplifier Applications" by Burr-Brown Research Corporation, copyrighted in 1963 by Burr-Brown Research Corporation—pages 50–53; "Applications Manual for Operational Amplifiers" by Philbrick/Nexus Research, published 1969 by Philbrick/Nexus Research—sections II. 10, II. 11 and II. 12; "System Engineering Handbook" edited by Robert E. Machol in collaboration with Wilson P. Tanner, Jr. and Samuel N. Alexander, published by McGraw-Hill Book Company—pages 10-6, 10-8.

Electrical systems for actuating safety ski bindings have been in the course of development over the past few years. These systems basically provide for the generation of electrical signals in response to the occurrence of forces, and for the generation of a release signal for actuating a trigger mechanism to release the binding when the electrical signals exceed some predetermined threshold value which is intended to reflect a danger condition. Such systems are disclosed, for example, in U.S. Pat. Nos. 3,762,735 (Smolka), 3,774,922 (Smolka), 3,776,566 (Smolka) and 3,892,980 (Anderson). A mechanically operated switch closes a circuit to actuate a release solenoid in U.S. Pat. No. 3,367,672 (Tonozzi et al). German Patent Publication OLS No. 201,4935 (Agerer) describes a ski binding whose release setting is controlled by a computer according to various operating conditions. Another German Patent Publication OLS No. 2,049,994 (Pistol) provides a binding with an electrical release binding actuable by a foot switch or handle.

In some of the foregoing electrical ski binding release systems, the time characteristics of applied forces are also included in the measurements made to control actuation of the release mechanism. Accordingly, U.S. Pat. No. 3,907,317 (Marker et al) discloses an electrical ski binding release system including circuitry for measuring the mean value of applied forces taken over a period of time, and for effecting release of the binding when that mean value exceeds some threshold value. In another system described in U.S. Pat. No. 3,919,563 (Lautier et al), electrical signals corresponding to the magnitudes of applied forces are integrated over predetermined time periods, and the integrated signal is compared to a referenced value which is a threshold of release.

German Patent Application No. P 2721691 (Salomon) discloses an electrically operated ski binding having an electronic control system wherein electrical signals corresponding to sensed forces are damped inversely according to the duration of the signal on the hypothesis that the skier's leg can stand high forces for short periods but not for extended periods. In German Patent Application No. P 2726143 (Salomon), another ski binding control circuit is disclosed in which an electrical signal corresponding to sensed forces is compared to a variable threshold value, the variance being inversely proportional to the duration of the signal. The latter circuit transforms the input signal from an analog signal to a digital equivalent, and the digital signal is measured against the threshold value which is decreasing with time. Another electronic circuit for a ski binding release system is described in German Patent Application No. P 2736027 (Salomon), wherein a threshold of release against which processed input force signals are compared is automatically adjusted during skiing according to forces sensed during skiing.

In co-pending U.S. patent application Ser. No. 467,821 filed May 7, 1974, an electrical release system is disclosed wherein forces are transduced into electrical signals which are processed in an integrating circuit and in a time delay circuit. The respective output signals are compared with threshold reference signals, and a release signal is generated when the output of either the integrating circuit or the delay circuit exceeds the threshold value.

Another system incorporating integrating circuitry is discussed in U.S. Pat. No. 3,701,903 (Merhar) wherein a piezoelectric sensor in a vehicle generates electrical signals in response to impacts upon the vehicle, and the signals are processed in a voltage limiter and then processed in an integrating circuit. A detection circuit responsive to the integrated signal activates a passenger restraining system.

To the extent that the foregoing systems incorporate integrating networks for generating electrical signals to be processed in decision making circuitry, the integration is performed using fixed integrating parameters; that is, the time constant of integration is a constant in each case.

SUMMARY OF THE INVENTION

It is an object of the present invention to integrate electrical signals at rates dependent upon predetermined characteristics of the signals.

It is a further object of the present invention to provide an electronic integrating system for generating output signals at a controlled rate of integration by selectively integrating different functions of electrical signals according to the relative values of predetermined characteristics of input signals.

Another object of the present invention is to provide a system for selectively integrating different functions of electrical signals according to whether those signals are increasing or decreasing.

It is still a further object of the present invention to provide a system for generating electrical output signals in response to the occurrence of sensed forces as predetermined functions of time, wherein the output electrical signals are integrated functions of the input signals and the rate of integration is controlled according to whether the input forces are increasing or decreasing.

The invention further has as an object the provision of an electronic integrating system for generating output signals in response to input signals, where the integration rate is controlled according to the magnitude of the input signals.

A further purpose of the invention is to provide a system for generating an integrated electrical output response to input force signals, where the rate of integration depends upon the magnitudes of the input signals.

A still further object is to provide a system for providing an integrated output response to an input signal, wherein the integration rate depends upon the direction of change and the magnitude of the input signals.

Yet another object of the present invention is to provide circuitry for operating an electronic ski binding release system wherein release signals are generated in response to the occurrence of dangerous forces and wherein release under non-dangerous force conditions is avoided.

It is a more specific object of this invention to provide a circuit of the preceding type which effects the release of the ski binding system by processing signals whose value reflects the magnitude and duration of sensed forces according to one criterion when the input forces are increasing, and according to another criterion when the input forces are decreasing.

It is also a specific object of this invention to provide a circuit for effecting the release of a safety ski binding by processing signals whose value reflects the magnitude and duration of sensed forces to obtain an integrated output signal, wherein the rate of integration is controlled according to the magnitude of the sensed forces.

Another particular object of this invention is the provision of a release system for operating a safety ski binding, wherein an integration network is provided whose integration rate depends upon the direction of change of applied forces, and upon the magnitude of those forces.

Another object is to provide an integrating system for processing electrical signals wherein the rate of integration is variable according to some predetermined criterion.

Other objects will be apparent to those skilled in the art from the description to follow and from the appended claims.

The foregoing objects are attained according to preferred embodiments of the invention by the provision of a system for generating an integrated output response to an input, wherein the rate of integration depends upon characteristics of the input. Accordingly, means are provided for generating input electrical signals in response to inputs such as sensed forces. The input signals are processed to determine whether these signals are increasing or decreasing. When the signals are increasing, the signals are processed in one manner and tranmsitted to an integrating circuit which generates as an output signal, an integral of the input signal. If the input signals are decreasing, a different function of the input signal is transmitted to the integrating circuit, and the latter signal is integrated to effect the generation of an output signal. The rate of integration is controlled according to the magnitude of the input signals. When the magnitude of the input signals becomes more critical as it increases, the rate of integration is likewise increase. When such a system is used in a ski binding, the integrated signals are compared with a threshold of release value, and release of the binding is effected when the threshold is exceeded. The input signals in the latter situation are forces corresponding to forces applied to the ski binding, and a greater tolerance is permitted for decreasing forces than for increasing forces, wherefore under the same absolute force and time parameters, release occurs sooner for increasing forces than for decreasing forces. When the foregoing type of integrating circuit whose rate of integration is controlled according to the magnitude of the input signals is incorporated in an electronic ski binding release system, the integration rate is designed to be slow for small signals and fast for large signals, so that the rate of integration in effect tracks the applied forces to provide for actuation of the release mechanism only when danger situations arise.

BRIEF DESCRIPTION OF THE DRAWINGS

FIG. 7 is a block diagram of an embodiment of the present invention.

FIG. 8 is a more detailed block diagram of the system shown in the preceding figure.

FIG. 9 is a schematic diagram of the system shown in FIG. 8.

FIG. 10 is a force-time graph of a typical skiing situation using the system shown in FIGS. 7 and 8 as incorporated in an electronic ski binding system.

FIG. 11 is a force-time graph of the same system shown in FIGS. 8–10, but illustrated for step function changes in the applied forces.

DESCRIPTION OF THE PREFERRED EMBODIMENTS

Figure 1:
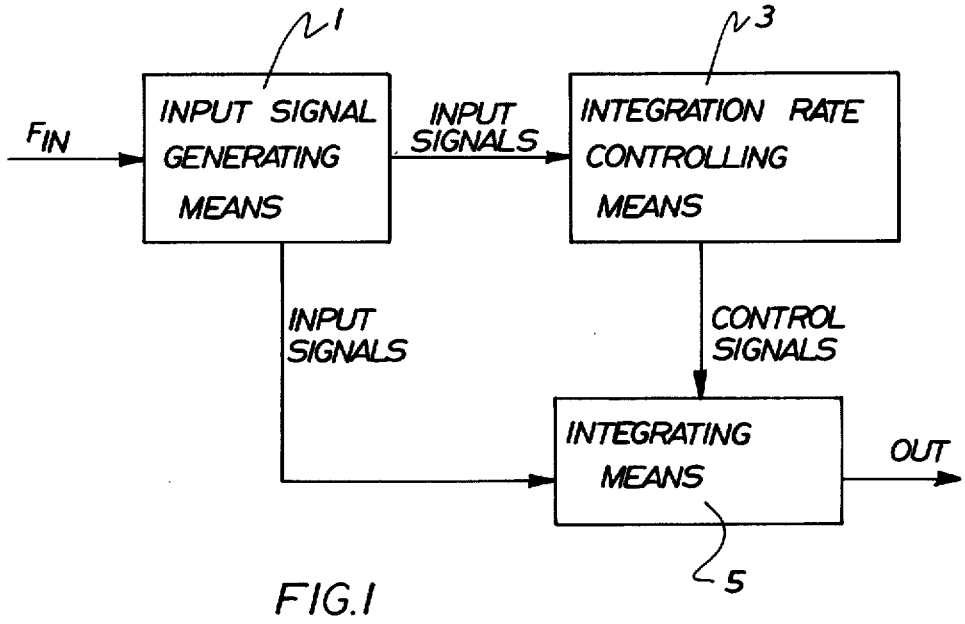
FIG. 1 is a block diagram of a system according to the present invention.

Referring first to FIG. 1, a system is shown in block form for processing input signals to obtain an integrated output response. An Input Signal Generating Means 1 generates input signals in response to the occurrence of one or more signals $F_{IN}$, and these input signals are transmitted to an Integration Rate Controlling Means 3 and an Integrating Means 5. Integrating Means 5 processes input signals to generate an integrated output response OUT at a variable rate of integration controlled by the output of Integration Rate Controlling Means 3. Means 3 generates control signals according to characteristics of the input signals IN, such as the direction of change of those signals (increasing or decreasing) and their magnitude.

Figure 2:
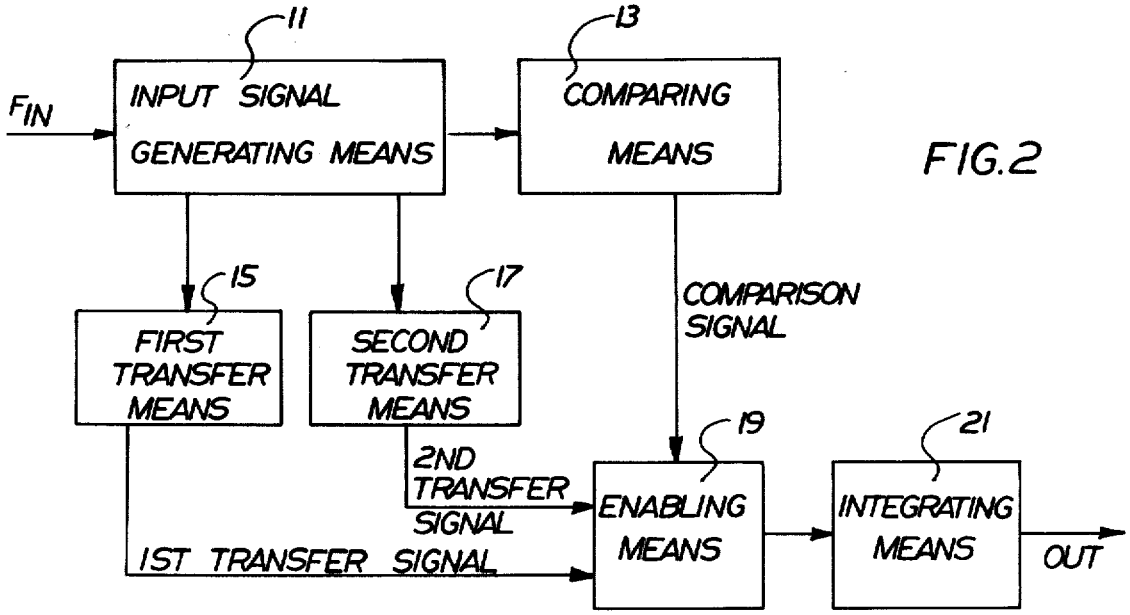
FIG. 2 is a block diagram of an embodiment of the invention.

Turning next to the block diagram shown in FIG. 2, an Input Signal Generating Means 11 is operatively connected to a Comparing Means 13 and to a plurality of transfer means shown as a First Transfer Means 15 and a Second Transfer Means 17. Comparing Means 13 and Transfer Means 15, 17 are operatively connected to an Enabling Means 19 whose output is operatively connected to an Integrating Means 21.

Input Signal Generating Means 11 generates input signals in response to one or more input force signals, $F_{IN}$. These input signals are transmitted to Comparing Means 13 and to First Transfer Means 15 and Second Transfer Means 17. The Transfer Means generate first and second transfer signals, which are first and second functions of the input signals. Enabling Means 19 selectively enable the transmission of transfer signals from one of Transfer Means 15, 17 to Integrating Means 21. Enabling Means 19 is under the control of Comparing Means 13. Comparing Means 13 compares input signals at sequential times, and generates comparison signals reflective of the relative values of the input signals. Enabling Means 19 enables the transmission of the transfer signals from the selected Transfer Means 15, 17 according to the value of the comparison signal. Integrating Means 21 generates an output signal OUT, which is an integration function of the transfer signal processed by the Integrating Means.

Figure 3:
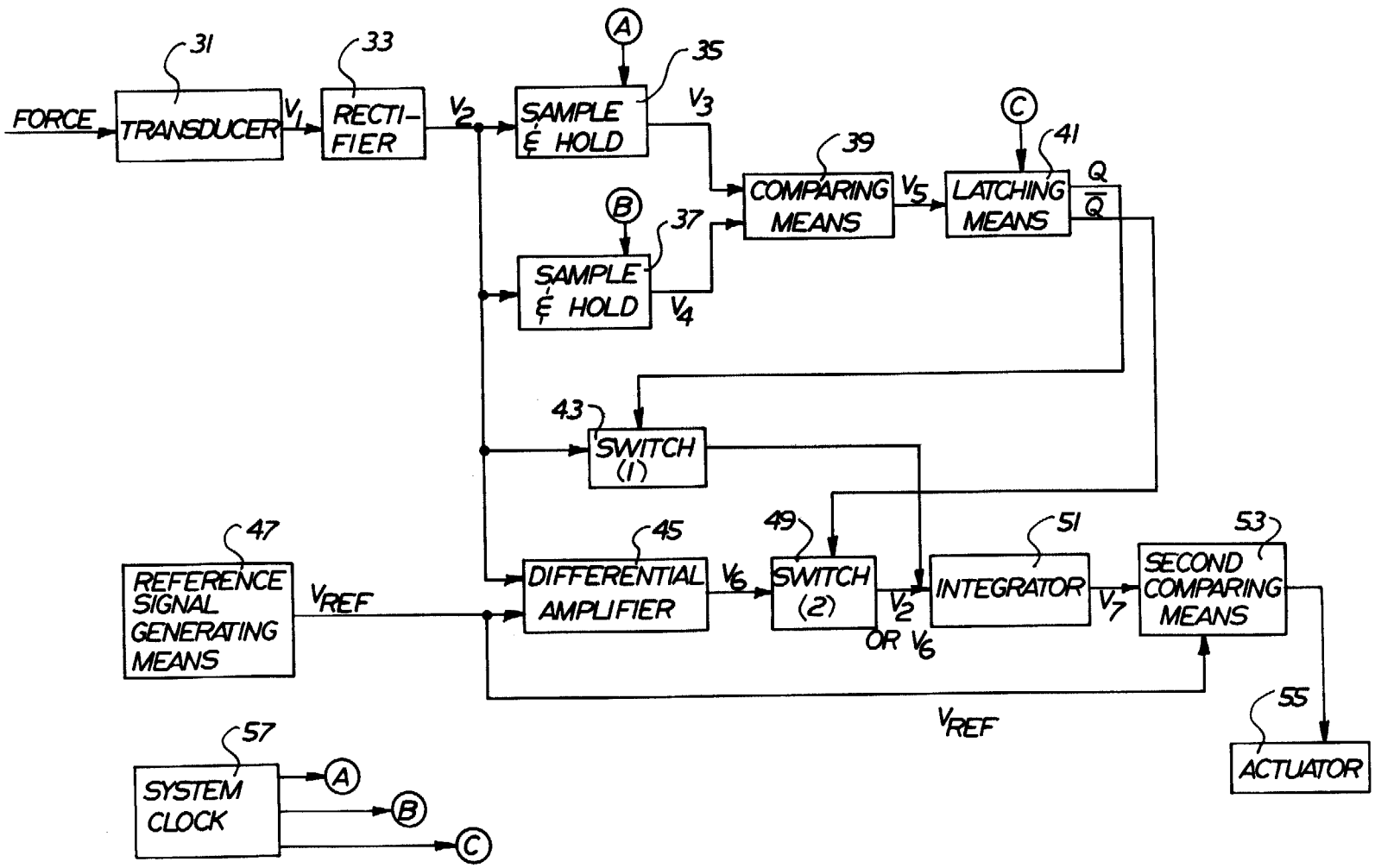
FIG. 3 is a more detailed block diagram of a system according to the present invention.

Another system which can be considered an embodiment of the system shown in FIG. 2, is depicted in FIG. 3. The system shown in FIG. 3 can be described as a tracking threshold integrator, and it is particularly adapted to respond to input force signals and to generate output signals when the time and magnitude characteristics of the force signals meet some predetermined criterion. More particularly, this tracking threshold integrator has the capability of processing signals corresponding to sensed forces and performing integration functions according to the sense (i.e., the direction—increasing or decreasing) of the sensed forces. The system finds a particularly useful application in conjunction with safety ski bindings, wherein the object is to actuate the release mechanism of the ski binding whenever the forces (including torques) are such as to make injury or damage imminent.

The tracking threshold integrator system of FIG. 3 comprises a transducer 31 for sensing applied forces and for generating electrical signals corresponding to those forces. The transducer is operatively connected to a rectifier 33 for eliminating either the positive or negative components of the input electrical signals. The output of rectifier 33 is operatively connected to sample and hold devices 35 and 37, and to other components as described below. Sample and hold devices 35 and 37 are both connected to a comparing means 39 which is in turn connected to a controlling means shown as a latching means 41. The output ports of latching means 41 are connected, respectively, to switching means shown as a first switch 43 and a second switch 49. A differential amplifier 45 has input ports connected respectively to rectifier 33 and to a reference signal generating means 47. Switch 43 is also connected to the output port of rectifier 33. An integrating means shown as an integrator 51 is operatively connected to differential amplifier 45 and to the output of rectifier 33, but interposed between those respective connections are switches 43 and 49. A second comparing means 53 is connected to the output port of integrating means 51, and the reference signal generating means 47 is also operatively connected to comparing means 53. An actuating means shown as an actuator 55 is operatively connected to the output port of comparing means 53. Sample and hold devices 35 and 37, and latching means 41, are under the control of timing signals as described below, and these timing signals are generated by a timing signal generating means shown as a system clock 57.

The system shown in FIG. 3 will be described as if it were incorporated in a safety ski binding, the function of the system being to actuate the release mechanism in the event that conditions arise which could cause damage or injury. As mentioned above, transducer 31 senses applied forces and generates input electrical signals $V_1$ corresponding to those sensed forces. The electrical signals are rectified by rectifier 33, which is connected to the sample and hold devices 35, 37, integrator 51 via switch 43, and differential amplifier 45. Sample and hold devices 35 and 37 receive in alternating sequence the signal $V_2$ transmitted by rectifier 33. The sample and hold devices 35, 37 are under the control of clock 57. Clock 57 generates a regular succession of pulses A, B and C (discussed later). Sample and hold device 35 is triggered upon the occurrence of a timing signal A, and sample and hold device 37 is triggered a short time later upon the occurrence of signal B. When the sample and hold devices are triggered, they each take a "sample" of the force signal $V_2$ from the rectifier 33 and store these values for a brief period of time. Typically, the sample and hold devices will take their respective samples at from 2 to 4 millisecond delays. The output signals from the sample and hold devices are transmitted to the input port of comparing means 39. The respective output signals of sample and hold devices 35 and 37 are shown as $V_3$ and $V_4$.

Comparing means 39 generates an output signal $V_5$ whose value is reflective of which of the two input signals $V_3$, $V_4$ is the larger; wherefore, the value of $V_5$ indicates whether the input force signals have increased or decreased during the measurement interval. The output signal $V_5$ of comparing means 39 is transmitted to latching means 41.

Latching means 41 is a "flip-flop" device, having two possible output signals. When the comparing means 39 output $V_5$ is high, latching means 41 stores at its Q-output the high level upon the occurrence of a timing signal or pulse C from the system clock 57. On the other hand, when comparing means 39 is low, latching means 41 will store at its Q-output a low level when a timing signal C occurs. Latching means 41 is placed in its high state when input signal $V_5$ indicates that the input force signals are increasing, and latching means 41 is placed in its low state when $V_5$ indicates that the force signals are decreasing. $\overline{Q}$ is the complement of Q and always has the opposite level of Q; therefore when the Q-output of latching means 41 is at a low level, $\overline{Q}$ is at the high level. The resulting Q and $\overline{Q}$ levels close switches 43 and 49, according to which of the two has the high level. When switch 43 is closed, input signal $V_2$ is transmitted to integrator 51, whereas when switch 49 is closed, the output of differential amplifier 45 is the input signal to integrator 51.

Differential amplifier 45 receives at its input port input signal $V_2$ generated by transducer 31, and a reference value $V_{REF}$ from reference signal generating means 47. For reasons explained hereinafter, $V_{REF}$ can advantageously have a value corresponding to the threshold of release which establishes the criterion against which processed signals are compared to determine whether or not to release the ski binding. Differential amplifier 45 generates a signal $V_6$ corresponding to the amplified difference between the values of $V_{REF}$ and $V_2$.

When switch 43 is actuated by an appropriate signal from latching means 41, input signal $V_2$ is transmitted to integrator 51 for processing in the latter network. On the other hand, when switch 49 is actuated by an appropriate signal from latching means 41, signal $V_6$ is processed in integrating means 51. When input signals $V_1$ are increasing, comparing means 39 generates a signal $V_5$ reflective of this occurrence, and latching means 41 generates an appropriate signal (Q high) to close switch 43 and transmit the input signal $V_2$ to integrator 51. When the input signals are decreasing, signal $V_5$ effects the storage of a switching signal ($\overline{Q}$ high) to close switch 49, to enable the transmission of the signal $V_6$ to integrator 51. In other words, when the input forces are increasing, the input to integrator 51 is the difference between the input signal and a first reference value ($V_{REF}=0$), and when the input forces are decreasing, the input to integrator 51 is the difference between the input signal and a second reference value ($V_{REF}\neq 0$). In the latter situation for the ski binding application, $V_{REF}$ is the value of the threshold of release, wherefore the rate of integration of integrator 51 for both in situations of increasing forces and of decreasing forces, is dependent upon the difference between the magnitude of input signal $V_2$ and the particular reference against which it is being compared during the immediate measuring interval.

These signals ($V_2$ or $V_6$) are continuously transmitted to integrator 51 at a rate dependent upon the frequency of timing signals C. Integrator 51 generates an output signal $V_7$ which is a function of the integral of the input signal $V_2$ or $V_6$. The output of integrating means 51 is cumulative in the absence of a reset switch. However, by an appropriate selection of $V_{REF}$ (i.e. $V_{REF}>V_2$ under normal conditions), provision is made for signals $V_2$ and $V_6$ to be of opposite polarity. The rate at which $V_7$ increases or decreases is a function of the magnitude of the input signals $V_2$. In a normal skiing situation, sensed forces are constantly increasing and decreasing, wherefore the output of $V_7$ of integrating means 51 increases and decreases around some nominal value, but as soon as an input force persists with little or no relaxation (a characteristic of an impending crash or other danger situation), $V_7$ continues to increase in value at a rate determined by the magnitude of the input force. The second comparing means 53 compares the output $V_7$ of integrating means 51 with the threshold of release $V_{REF}$ established by reference value generating means 47, and when $V_7$ exceeds $V_{REF}$, a signal is transmitted to actuator 55 to effect the release of the ski binding.

Figure 4:
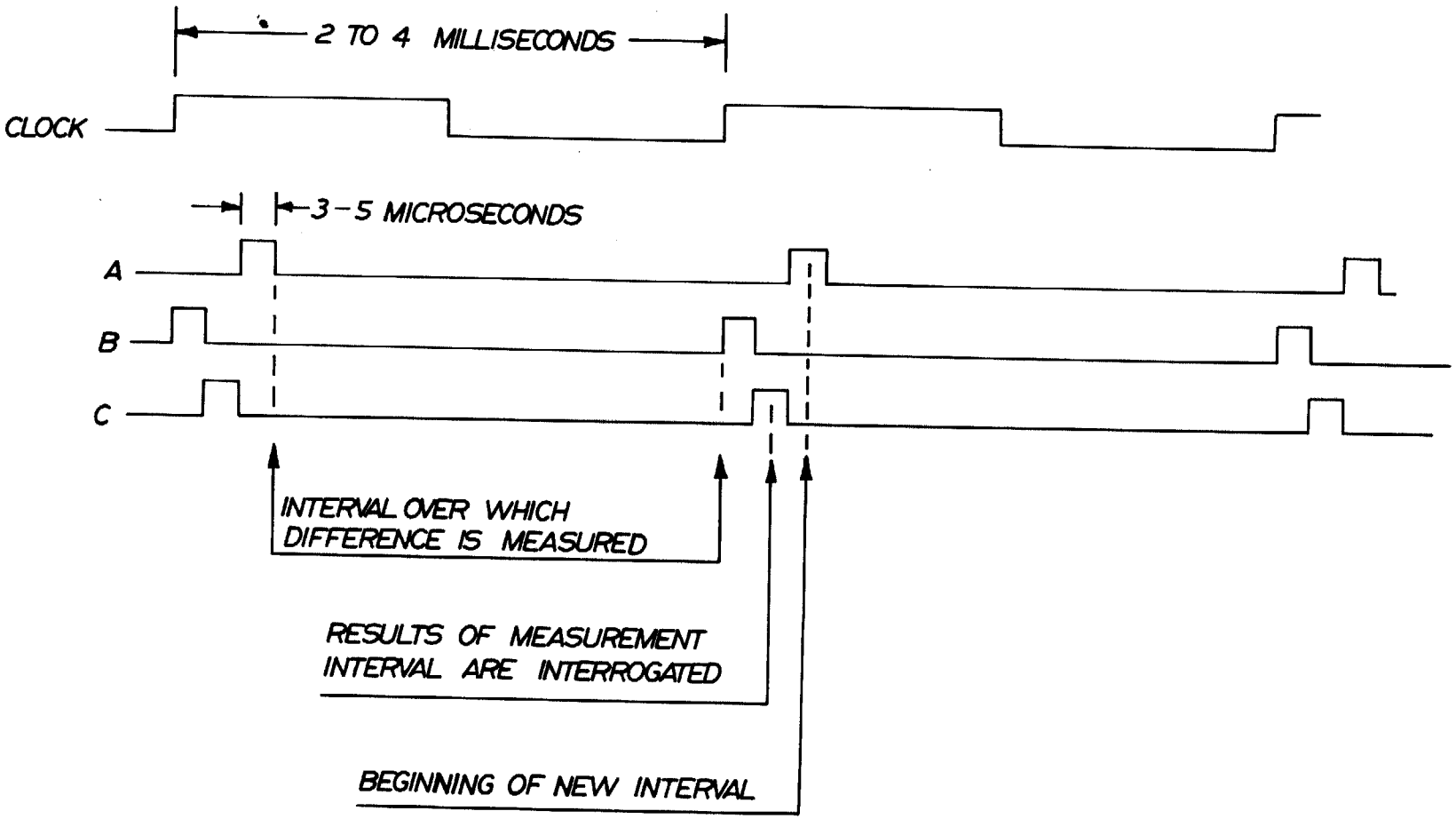
FIG. 4 is a timing diagram for the diagram shown in FIG. 3.

A graphical representation of the output of the timing signal generating means or system clock 47 is shown in FIG. 4. The uppermost curve in FIG. 4 indicates the operation of the basic system clock. It will be seen that the period of the clock signal is selected to be in the range of from 2 to 4 milliseconds, although other time periods could be selected. Timing signals A, B and C are generated in sequence, and each commences with a positive going edge and terminates with a negative going edge, using the horizontal datum line as the reference. FIG. 4 indicates that upon the termination of a timing signal B, a timing signal C commences; and that upon the termination of a timing signal C, a timing signal A commences. The timing signals are in effect pulses, whose duration is shown to be from 3 to 5 microseconds; however, other values could be selected. The respective pulses occur according to the frequency of the clock, that is the respective pulses occur every 2 to 4 milliseconds.

Figure 5:
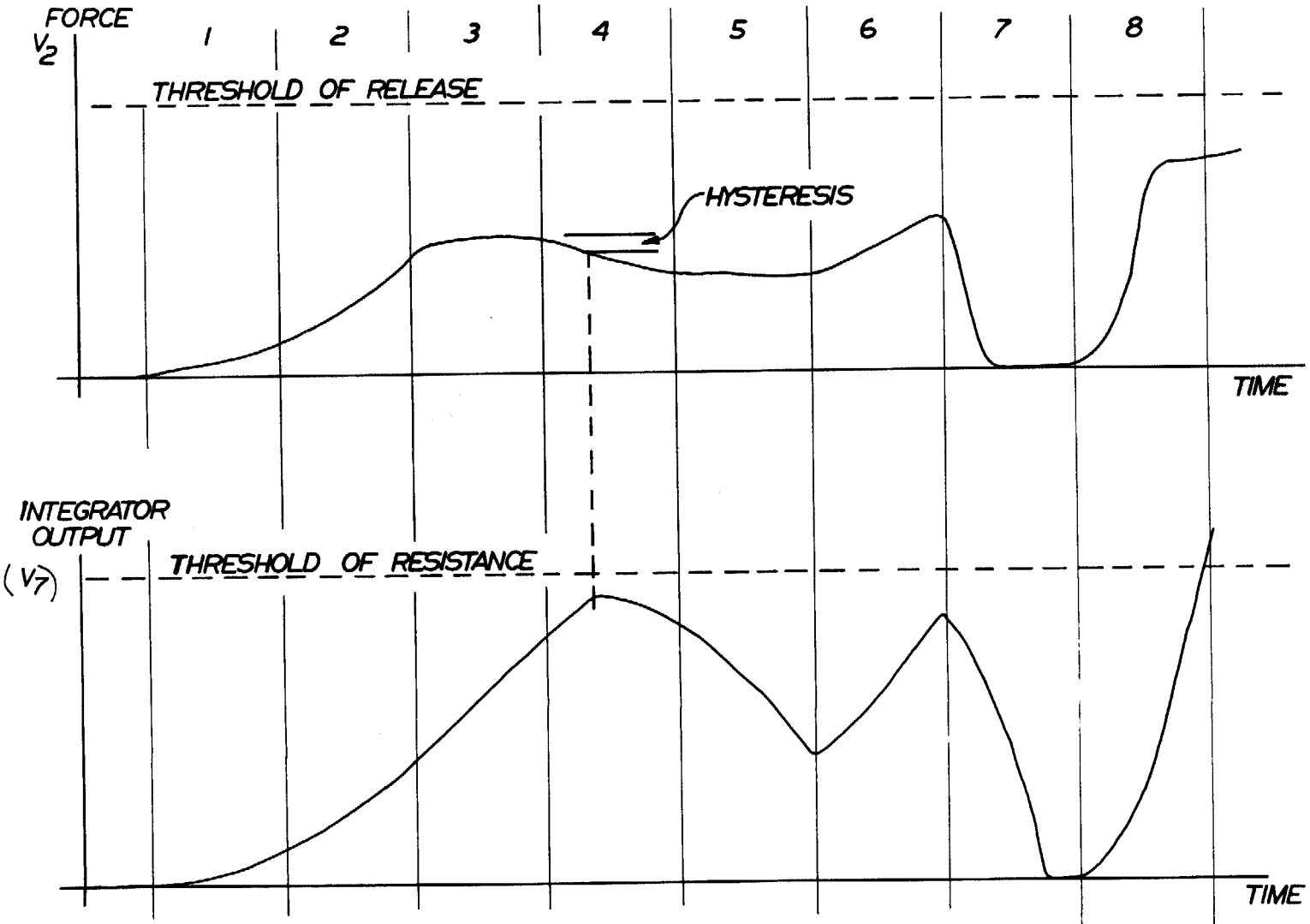
FIG. 5 is a graphical representation of a typical skiing situation using the system shown in FIG. 3 as incorporated in a safety ski binding.

A graphical representation showing the relationship between the input signals $V_2$ and the integrator output $V_7$ over a period of time is depicted in FIG. 5.

The upper portion of FIG. 5 plotting force or the corresponding input signal $V_2$ against time, shows a hypothetical but typical force pattern likely to be encountered in a skiing situation. The dotted line labeled "threshold of release" indicates the magnitude of forces which are deemed dangerous to the skier or his equipment. The time scale of the two graphs of FIG. 5 are broken into equal time intervals labeled 1–8. At time 0, the applied force is shown as being of 0 value, and this force is shown to increase gradually over the first two time intervals, while maintaining a relatively low magnitude. Referring to the lower graph, it may be seen that the integrator output $V_7$ increases gradually as the input force $V_2$ increases through the first two time intervals. The rate of increase of value of $V_7$ increases in the second time interval reflective of the increasing magnitude of the input signal $V_2$. In the third time interval, the force signal $V_2$ maintains a relatively constant value, wherefore the rate of integration reflected by the slope of the curve $V_7$ is steady or linear, but $V_7$ does increase in value. In the fourth time interval, the applied force (and signal $V_2$) decreases slightly by an amount which satisfies the value of hysteresis built into the comparing means 39, and upon the termination of the hysteresis effect, the decreasing force effects a reversal of the direction of integration in integrator 51. The dotted vertical line indicates that as the force decreases, the magnitude of $V_7$ decreases also, and the rate of this negative integration increases as the force $V_2$ decreases. The rate of decrease of $V_7$ in quite small in the sample shown, since for decreasing force signals, the input to integrator 51, $V_6$, is the difference between $V_2$ and $V_{REF}$ and the actual force $V_2$ is relatively close to that $V_{REF}$ where the latter value is the threshold of release.

The input force $V_2$ decreases slightly during time interval 5, and the integrated response $V_7$ decreases at an increasing rate because of the increased difference between the input force signal $V_2$ and $V_{REF}$.

The force signal begins to increase during the 6th time interval, and again the direction or polarity of the output $V_7$ of integrator 51 changes and begins to increase. $V_7$ increases at an increasing rate reflective of the increase in value of $V_2$ which is now the input to integrator 51. At time interval 7, the input force is removed and the input force signal rapidly drops to 0. The output of integrator 51 also decreases and it too eventually reaches a 0 value, the rate of decrease being quite fast since the difference between $V_{REF}$ and the integrator input is large (since $V_2$ went to 0).

The force again begins to increase during interval number 8, and the force increases to a relatively high value although below the threshold of release. (Although not shown in the drawings, it is contemplated that circuitry would be included for effecting release when the magnitude of the force exceeds the threshold of release, possibly for a predetermined time period, independent of the output integration system). Nevertheless, the input force persists long enough for the integral of the input force $V_2$ to exceed the threshold of release. Upon the latter event, the second comparing means 53 generates a signal to energize actuator 55 to cause the binding to assume its release condition.

The system shown in FIG. 3 thus incorporates an integrator whose output reverses direction every time there is a reversal in the direction or sense of the applied force, regardless of the absolute magnitude of that force. The integrator output does not reach a release condition unless the signals accumulated therein correspond to energy of a given polarity and stored in the skier's leg for a sufficient period of time to call for release of the binding. Therefore, the integrator does not continuously maintain an increasing charge which could conceivably cause release under non-danger conditions, because the polarity or sense of the applied forces is taken into consideration, along with their magnitude, by the integration network.

A detailed schematic diagram of a circuit for the tracking threshold integrator described above is illustrated in FIG. 6. The circuit includes a bridge circuit 61 having four active legs shown as force-responsive variable resistors whose resistance values are $R \pm \Delta R$, these resistors being sensors or transducers. An amplifier A1 has positive and negative ports connected to circuit 61, A1 functioning to amplify the output from the bridge 61 to a usable level. The output of amplifier A1 is $V_1$. A feedback resistor R1 is connected across amplifier A1. The output of amplifier A1 is transmitted to amplifiers A2 and A3 which, with their associated resistors R2, R3, R4, R5 and R6, and diodes D1 and D2 rectify the output $V_1$ of amplifier A1 so that the output of this rectifier circuit is always of the same polarity, e.g. positive. The output of the rectifier circuit is shown as $V_2$. Switches S1 and S2 taken in conjunction with their respective capacitors C1 and C2 correspond to the sample and hold devices shown in FIG. 3. Switches S1 and S2 close in response to the generation of timing signals A and B. These timing signals are generated by the circuit shown in the lower portion of FIG. 6, the latter including an oscillator or system clock, and three monostable multivibrators M1, M2 and M3. The latter three devices generate the timing signals A, B and C. The positive-going edge of the clock signal triggers multivibrator M1, causing its output to go high for a predetermined period of time which defines the duration of the B signal. The negative-going edge of the B signal triggers multivibrator M2 to generate the C signal, and the negative-going edge of the C signal triggers multivibrator M3 to generate timing signal A. The relationship between the timing signals was discussed earlier with regards to FIG. 4.

Assuming that the measurement interval for processing signals to control the operation of the release mechanism of the ski binding commences with a timing signal A, upon the occurrence of signal A switch S1 is momentarily closed and capacitor C1 charges to the value of $V_2$. At the conclusion of the A signal the remainder of the clock interval passes, and the B signal is generated to momentarily close switch S2 and the then value of $V_2$ is stored in capacitor C2. Amplifiers A4 and A5 whose positive ports are connected respectively to capacitor C1 and C2, are high input impedance voltage followers and are used to assure a negligible loss of charge from the capacitors C1 and C2 during the measurement interval. Amplifier A6 corresponds to comparing means 39 in FIG. 3, and functions to compare the output signals $V_3$ and $V_4$ of the sample and hold devices. A6 generates a high level output response if $V_4$ exceeds $V_3$, and generates a low level output response if $V_3$ exceeds $V_4$; the former situation indicating an increase in the input signals, and the latter situation indicating that the magnitudes of the input signals are decreasing. F1 designates a D-type "flip-flop" and corresponds to the latching means 41 in FIG. 3. The level (0 or 1) appearing at the D-port of flip-flop F1 is transferred to the Q-output when the clock input CLK of flip-flop F1 is triggered by timing signal C. When the input force is increasing, a high level output signal Q-high is generated by flip-flop F1, whereas when the input force is decreasing, the output response of flip-flop F1 is high.

Figure 6:
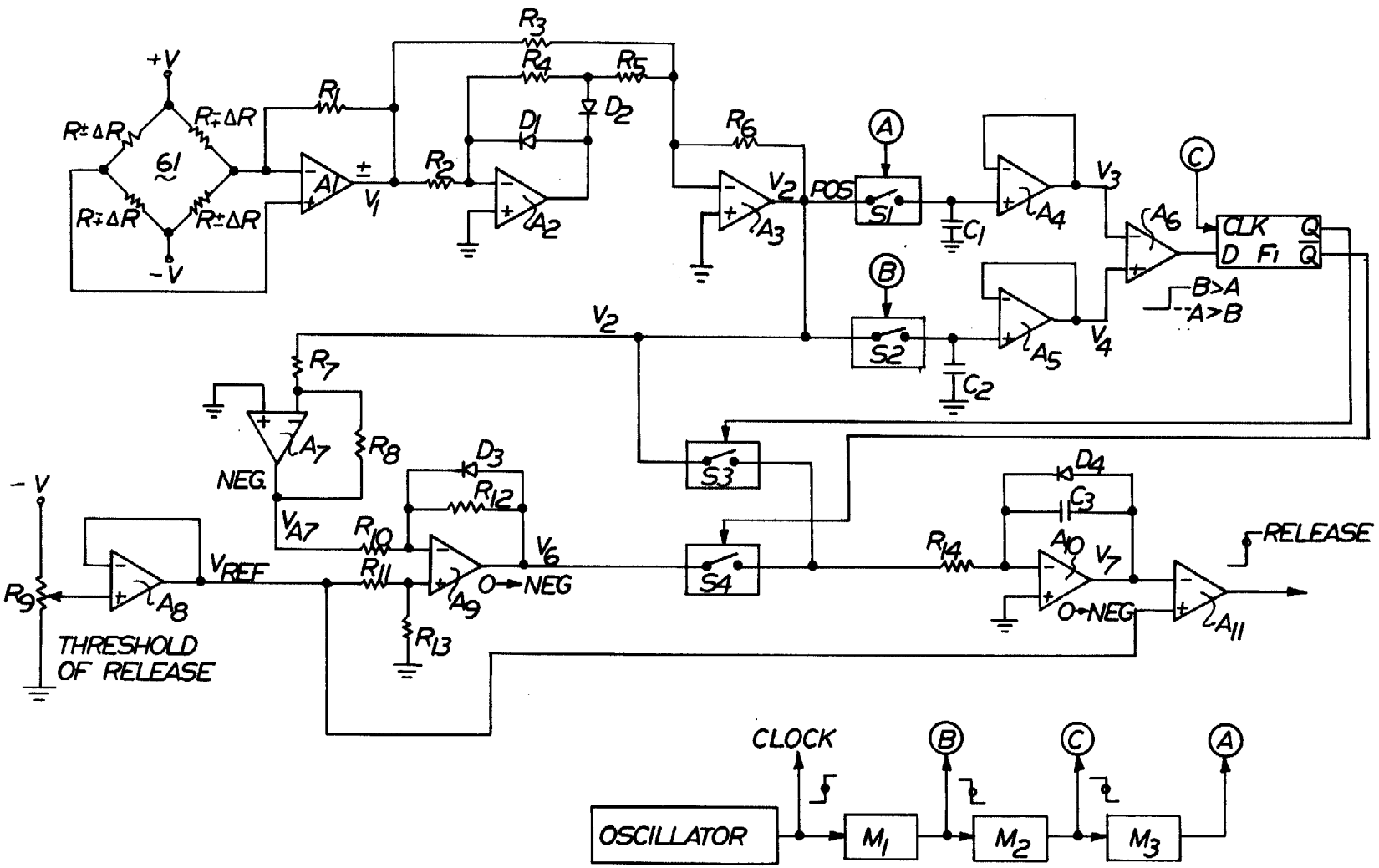
FIG. 6 is a detailed schematic diagram of the system shown in FIG. 3.

The integrating means of the circuit shown in FIG. 6 comprises an operational amplifier A10 having a resistor R14 connected to its negative input port, and across which are connected a capacitor C3 and a diode D4. D4 prevents amplifier A10 from ever going positive because a positive polarity would cause an error in the processing logic of the system.

Amplifier A8 and potentiometer R9, together with voltage source $-V$, form the reference value generating means shown in FIG. 3, wherein the reference value is selected to be the threshold of release as discussed previously. Amplifier A8 is a high impedance voltage follower, and functions to avoid any error in the threshold of release as a function of changing load conditions in the follow-up networks. Amplifier A7 is operatively connected to the input signal generating circuitry, and functions to invert its positive force input signal. Both of amplifiers A7 and A8 are connected to the input port of a differential amplifier A9, and the inversion of the input to amplifier A7 makes the input polarities of the signals transmitted to differential amplifier A9 compatible. R8 is a feedback resistor connected across A7. Differential amplifier A9 receives the output of amplifier A8 through a resistor R11 at its positive input port, and receives the output of amplifier A7 through a resistor R10 at its negative port. A feedback resistor R12 is connected across amplifier A9 and a diode D3 also connected across this differential amplifier keeps the differential amplifier from ever going positive to avoid polarity caused errors in the processing logic of the system.

By selecting the resistors R10–R13 so that the following relationship is obtained:

$$R12/R10 = R13/R11$$

where R = the resistance of the respective resistors, the output $V_6$ of amplifier A9 will obey the following relationship:

$$V_6 = -\frac{R12}{R10}(V_{REF} - V_{A7})$$

where $V_{A7}$ is the output of amplifier A7. Therefore, if the output $V_{A7}$ (which is a function of the force signal) of amplifier A7 is almost as large as the threshold of release $V_{REF}$, the difference signal $V_6$ is very small; and when $V_6$ is transmitted to the integrator amplifier A10 upon the closing of switch S4, the output $V_7$ of the integrator decreases towards a 0 voltage value very slowly. On the other hand, if $V_{A7}$ is small, the difference between $V_{REF}$ and $V_{A7}$ is large; and if S4 is closed, the integrator output $V_7$ proceeds toward a 0 voltage at a much faster rate. This explains the shape of the curves in time intervals 4, 5 and 7 in FIG. 5.

The integrator of FIG. 6 selectively receives input signals $V_6$ or $V_2$ according to which of switches S3 and S4 is closed. When the force is increasing, the Q-level is high on flip-flop F1, causing switch S3 to close wherefore the signal $V_2$ is processed by the integrator. On the other hand, when the input force is decreasing, the $\overline{Q}$ level of flip-flop F1 is high, and switch S4 is closed so that signal $V_6$ is the one which is processed by the integrator.

In some situations, such as when the systems disclosed herein are employed in conjunction with safety ski bindings, it has been found to be desirable to increase the integration rate as the applied forces increase, to effect a release sooner upon the occurrence of high forces, since the risk of damage or injury is greater for high forces under given time parameters. Accordingly, the integration circuitry can be refined to provide for an adaptive integration rate to speed up the response of the system as the value of the applied force increases. Referring to FIG. 7, a block diagram is shown comprising an input signal direction selecting means 71 whose output is directed to a signal conditioning means 73, whose output in turn is connected to the previously discussed integrating means 5. The input signal direction selecting means generates a signal indicative of whether input signals are increasing or decreasing. The signal conditioning means modifies the foregoing signals according to the magnitude of the input signal. In the ski binding application of this system, the magnitude of the input signal would in effect be increased by the signal conditioning means to increase the integration rate of the integrating means, although in other applications a different adjustment to the input signal might be made. The circuit in FIG. 7 thus modifies the output of the integrating means according to two separate factors, one being the direction or sense of the input signal (increasing or decreasing), and the other being the magnitude of the input signal.

A more detailed system of the type shown in FIG. 7 is illustrated in FIG. 8, as incorporated in a system of the type shown in FIG. 2. In the preceding FIGS. 2–6, the integration rate varied according to the direction of change of the input signals (increasing or decreasing). In the system of FIGS. 7–9, the integration rate is further varied according to the magnitude of the input signals. The system in FIG. 8 is particularly useful in safety ski binding applications, and in essence provides for a slow integration rate for low input signals and a fast integration rate for large signals. (Prior integrators have the same integration rate for all signal levels). In FIG. 8, a force signal is transmitted to a rectifier as discussed with regard to FIG. 3, and the output of the rectifier is transmitted to the Direction Selection Network 81 (corresponding to the system of FIG. 3). Network 81 responds to the generation of timing signals A, B and C and to comparison signals Q and $\overline{Q}$ as described with regard to FIGS. 3 and 6. Two Signal Conditioning networks 83 and 85 are provided for receiving and processing input signals according to whether the input force is increasing or decreasing. When the force is increasing, network 83 is actuated to effect an integration rate which increases as the magnitude of the input force increases; whereas when the force is decreasing network 85 effects an integration rate which increases as the magnitude of the input force falls further and further below the upper reference $V_{REF}$ as described in FIGS. 3, 5 and 6. The output of the selected network 83 or 85 is processed by the integrator and comparator as discussed previously.

FIG. 9 shows a more detailed circuit which, when incorporated in the circuit of FIG. 6 between switches S3 and S4 and amplifier A10, functions to control the integration rate according to the magnitude of the input force signals. Connected across the input lines to the integrator, (comprising amplifier A10 and capacitor C3) are parallel connections of zener diodes (Z1, Z2 . . . ZN; Z1', Z2' . . . ZN') and resistors (R15, R16 . . . RN; R15', R16' . . . RN'), there being separate input lines for each of switches S3 and S4 (it being recalled that S3 is closed when the input signal is increasing, and S4 is closed when the input signal is decreasing). The added effect of the voltages $V_{S2}$, $V_{S3}$ . . . $V_{SN}$ and $V_{S2'}$, $V_{S3'}$ . . . $V_{SN'}$ depends upon the activation of the zener diodes. (The input to the integrator has heretofore been identified as $V_2$ or $V_6$. To avoid confusion, these inputs are referred to now as $V_{S1}$, etc. and $V_{S2}$, etc.) As these zener diodes reach their breakdown points, the input to the integrator increases by the voltage in the line controlled by the zener diode to increase the input to the integrator—and the integration rate.

When the input force is increasing, switch S3 closes in response to signal Q; and when the input force is decreasing, switch S4 closes in response to signal $\overline{Q}$. Until the input signal exceeds the break point of zener diode Z1 or Z1', the input to the integrator is $V_{S1}$. When the break point of Z1 or Z1' is reached, the effect of $V_{S2}$ or $V_{S2'}$ is impressed on the integrator.

Expressed mathematically, without the presence of the zener diode circuitry (as in the prior art), the output of the integrator is expressed as $$V_0 = \frac{1}{RC}\int_0^t V_{IN}(t)dt$$

where $V_0$=integrator output
R=resistance load at the integrator input
C=capacitive load across the integrator
$V_{IN}(t)$=integrator input as a function of time
t=time In the case of the circuitry shown in FIG. 9, the integrator output is expressed as follows when switch S3 is closed:

$$V_o = \frac{1}{C3}\left[\frac{1}{R14}\int_0^t V_{S1}(t)dt + \frac{1}{R15}\int_0^t V_{S2}(t)dt + \ \ldots\right]$$

($V_0$ has a corresponding value when switch S4 is closed, with the "prime" (') values replacing those shown above).

If all of the resistors have the same value (R), the latter expression reduces to:

$$V_o = \frac{1}{RC3} \int_o^t [V_{S1}(t) + V_{S2}(t) + \ldots]dt$$

where

R = resistance of the resistors shown

C3 = capacitance load across the integrator $V_{S1}$etc. = voltage in the respective lines of the circuit shown.

The values assigned to the zener diodes will determine the value of input force ($V_{S1}$) where each of the subsequent inputs ($V_{S2}$ through $V_{SN}$) contribute to the expression.

| | | |
|---|---|---|
| i.e. | $V_{S2}$ = VS1 − VZ1 | (VS1 > VZ1) |
| | $V_{S3}$ = VS1 − VZ2 | (VS1 > VZ2) |
| | . | |
| | . | |
| | . | |

It is seen that a "piecewise linear" approximation of virtually any nonlinear integrator transfer function can be realized with the appropriate selection of the zener diode "breakpoints". Further flexibility can be added by the selection of the associated resistor values at the input. The greater the number of "breakpoints", the smoother the approximation. Furthermore, the characteristics can easily be changed from application to application (or, in the case of ski bindings, from binding to binding depending on level of skill of the skier) by simply plugging in a different zener/resistor network (or perhaps by making them switch-selectable or "burn link programmable"). The same situation holds for the downward or negative integration when switch S4 closes to activate Z1' through ZN' while S3 deactivates Z1 through ZN. (As noted above, the foregoing discussion applies to the portions of the circuit controlled by each of switches S3 and S4. In the case of the S4-controlled circuit, the input to the integrator is a negative value which in effect causes a reverse integration.)

FIG. 10 shows a force-time graph of the integrator as it responds to both the tracking threshold and the rate adaptive integration. The primary objective of FIG. 10 is to show the greatly increased rate of change in the integrator output as each of the breakpoint voltages (FIG. 9) is exceeded, both in the forward and reverse directions of the integrator output. The breakpoint voltages are shown as being evenly distributed for clarity; however, they can be distributed in any manner to give the desired results.

In FIG. 10, which like FIG. 5 is divided into a series of time intervals 1–8, it should be observed that as the breakpoints of the zener diodes are passed by the voltages thereacross, a corresponding change occurs in the integrated output response $V_o$. Thus, as the input force increases over the first 3 time intervals and exceeds the zener breakpoints $V_{S1}$, $V_{S2}$, and $V_{S3}$, the rate of increase of the integrated response increases. As the input decreases and passes the zener breakpoints in intervals 4–6, the integrated response decreases at increasing rates. The 0 input in intervals 6 and 7 is reflected in the integrated response. Finally, when the input increases to a high value (below the threshold of release) in interval 8, the integrated response exceeds the threshold of release to achieve the result previously discussed.

Referring next to FIG. 11, which is a graphical representation similar to FIG. 10, but wherein the respective input signals are of constant value with step changes, and the integrated output response is a linear ramp (for the illustrated circuit of FIG. 8). (Non-uniform time intervals are used in FIG. 10 for purposes of this explanation). As in the case of FIG. 9, as the input assumes increasing or decreasing values, the magnitude of the integrated output response $V_o$ changes accordingly. Since within each breakpoint range of the zener diodes, the inputs are shown as having a constant value, the rate of change of the output $V_o$ is linear or constant. However, in each case where a breakpoint is passed (intervals 3–9), the rate of change of the output $V_o$ changes accordingly.

The rate adaptive system for an integrating means of FIGS. 7 and 8 has been shown and discussed in conjunction with the tracking threshold system of FIGS. 2, 3, and 6. Although in many situations these systems are fully compatible and highly advantageous, the rate adaptive integrator can be used and operated in conjunction with an integrating means, independently of (and in the absence of) the tracking threshold system. Likewise, the tracking threshold system can function independently of and in the absence of the rate adaptive system.

It should be appreciated that the embodiments of the invention described above satisfy the objects of this invention. Means have been provided for precisely controlling the integration rate of an integrating means according to predetermined characteristics of input signals. When incorporated in a safety ski binding, the release operation can be very precisely controlled without premature release signals being generated unless a true danger situation is present.

The invention has been described in detail with particular emphasis on preferred embodiments, but it should be understood that variations and modifications within the spirit and scope of the invention may occur to those skilled in the art to which the invention pertains.

I claim:

1. A system for generating an analog electrical output signal in response to the occurrence of one or more input signals, said system comprising:

input signal generating means for generating analog input signals having certain characteristics;

integrating means operatively connected to said input signal generating means for processing the input signals at a variable rate of integration to obtain an integrated analog output signal;

integration rate controlling means operatively connected to said input signal generating means and to said integrating means for generating control signals for controlling the rate of integration of said integrating means according to predetermined characteristics of said input signals; and comparing means for determining whether the input signals are increasing or decreasing, and for generating said control signals to control said rate of integration according to whether the input signals are increasing or decreasing.

2. The invention according to claim 1 wherein said integration rate controlling means comprises means for determining the magnitudes of said input signals, and for generating said control signals to control said rate of integration according to the magnitude of the input signals.

3. A system for generating an electrical output signal reflective of the direction of change of an input signal, said system comprising:

input signal generating means for generating at least one electrical input signal:

first and second transfer means electrically connected to said input signal generating means for generating first and second transfer signals which are first and second functions of said input signals;

comparing means electrically connected to said input signal generating means and actuable for comparing said input signals at sequential times, said comparing means generating comparison signals according to the relative values of said input signals;

integrating means electrically connected to said first and second transfer means for alternatively integrating said first and second transfer signals transmitted to said integrating means and for generating an integrated output signal;

enabling means interconnected to said integrating means and each of said first and second transfer means and to said comparing means, said enabling means being actuable in response to said comparison signals for selectively enabling the transmission of one of said first and second transfer signals to said integrating means according to the value of said comparison signal; and timing signal generating means electrically connected to said comparing means for generating sequential timing signals to actuate said comparing means.

4. The invention according to claim 3 wherein said comparing means comprises first and second sample and hold means electrically connected to said input signal generating means for alternately receiving and storing electrical input signals, and comparator means electrically connected to said sample and hold means for periodically comparing the signals stored in said first and second sample and hold means, said comparator means generating a control signal indicating whether said input signals are increasing or decreasing according to the values of said stored input signals, for effecting the generation of said comparison signal.

5. The invention according to claim 4 wherein said comparator means further comprises latching means electrically connected to said comparator means and to said enabling means, said latching means generating said comparison signal for actuating said enabling means in response to said control signal.

6. The invention according to claim 5 wherein said comparison signal has a first value when said input signals are increasing, and a second value when said input signals are decreasing.

7. The invention according to claim 6 wherein said first and second values are complements of each other.

8. The invention according to claim 4 wherein said sample and hold means are each actuable in response to said timing signals said timing signal generating means alternately transmitting timing signals to said first and second sample and hold means.

9. The invention according to claim 3 wherein said first transfer means comprises means for generating a first transfer signal corresponding to said input signal.

10. The invention according to claim 3 wherein said second transfer means comprises:

reference signal generating means for establishing a reference value corresponding to a predetermined value;

difference means electrically connected to said input signal generating means for establishing a differential signal corresponding to the difference in value between said input signal and said reference value, said difference means being electrically connected to said integrating means; and said enabling means is interposed between said difference means and said integrating means for effecting the transmission of said differential signal to said integrating means in response to a comparison signal to selectively effect said transmission.

11. The invention according to claim 10 and further including second comparison means electrically connected to said integrating means and to said reference signal generating means, for comparing the output of said integrating means and said reference value, and generating a second comparison signal indicative of the relative values of said output and said reference value.

12. The invention according to claim 3 wherein:

said first transfer means comprises means for generating first transfer signals corresponding to said input signals;

said second transfer means comprises difference means for comparing said input signals with predetermined reference values and for generating differential signals reflective of the differences in value between said input signals and said reference values;

said comparing means comprises:

first and second sample and hold means electrically connected to said input signal generating means for alternating receiving and storing electrical input signals; and comparator means electrically connected to said first and second sample and hold means for comparing sequential signals stored in said sample and hold means, and for effecting the generation of a first comparison signal when said input signals are increasing and a second comparison signal when said input signals are decreasing; and said enabling means comprises switching means for enabling only the transmission of the first transfer signals corresponding to said input signals to said integrating means in response to a first comparison signal indicating that the input signals are increasing, and for enabling only the transmission of the second transfer signals corresponding to the differential signals to said integrating means when the input signals are decreasing.

13. In a safety ski binding having a release means actuable for placing the binding in a releasing condition from a latching condition, a system for actuating said release means, said system comprising:

transducing means for generating electrical input signals corresponding to forces applied to the ski binding;

first and second sample and hold means electrically connected to said transducing means for alternatively receiving and storing said input signals;

first comparing means electrically connected to each of said sample and hold means for periodically comparing the signals stored in said sample and hold means for generating first comparison signals when the relative values of the signals received from said sample and hold means indicate the input signals are increasing, and second comparison signals when the relative values of the signals received from said sample and hold means indicate the input signals are decreasing;

reference signals generating means for establishing a reference value corresponding to the value of force at which the binding is to be placed in the releasing condition;

difference means electrically connected to said reference signal generating means and to said transducing means for comparing said input signals with said reference value and for generating a differential signal reflective of the difference between the values of said input signals and said reference value;

integrating means electrically connected to each of said transducing means and said difference means for selectively generating an integrated signal corresponding to the integral over a predetermined period of time of the selected one of said input signals and said differential signals;

switching means electrically connected to said first comparing means, to said difference means and to said integrating means, for enabling the transmission of said input signals to said integrating means in response to the generation of a first comparison signal and for enabling the transmission of said differential signal in response to the generation of a second comparison signal;

second comparing means electrically connected to said integrating means and to said reference signal generating means for comparing said integrated signal with said reference value and for generating a releasing signal when said integrated signal exceeds said reference value; and actuating means for placing the ski binding in the releasing condition in response to the generation of a releasing signal.

14. A system for controlling the rate of integration of an electrical input signal and generating an integrated output signal corresponding to an integral of said electrical signal over a period of time, said system comprising:

input signal direction selecting means for determining whether the electrical input signal is increasing or decreasing and for generating direction selection signals reflective of the direction of change of said electrical input signal;

an electrical integrator for integrating an input to the integrator to generate the integrated output signal; and signal conditioning means electrically connected to said input signal direction selecting means and to said integrator for adjusting the rate of integration of said system according to the value and direction of change said electrical input signal.

15. The invention according to claim 14 wherein said signal conditioning means increases the rate of integration in response to electrical input signals of increasing value, and decreases the rate of integration in response to electrical input signals of decreasing value.

* * * * *